US010352104B2

(12) United States Patent
Akhmadi Eko et al.

(10) Patent No.: US 10,352,104 B2
(45) Date of Patent: Jul. 16, 2019

(54) DRILL BIT BUTTON INSERT AND DRILL BIT

(71) Applicant: MITSUBISHI MATERIALS CORPORATION, Tokyo (JP)

(72) Inventors: Wardoyo Akhmadi Eko, Naka (JP); Toshihiko Matsuo, Naka (JP); Chihiro Sakurazawa, Naka (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 75 days.

(21) Appl. No.: 15/531,255

(22) PCT Filed: Nov. 26, 2015

(86) PCT No.: PCT/JP2015/083276
§ 371 (c)(1),
(2) Date: May 26, 2017

(87) PCT Pub. No.: WO2016/084914
PCT Pub. Date: Jun. 2, 2016

(65) Prior Publication Data

US 2017/0328136 A1 Nov. 16, 2017

(30) Foreign Application Priority Data

Nov. 27, 2014 (JP) ..... 2014-240087
Nov. 25, 2015 (JP) ..... 2015-230103

(51) Int. Cl.
*E21B 10/56* (2006.01)
*B25D 17/02* (2006.01)
(Continued)

(52) U.S. Cl.
CPC ..... *E21B 10/56* (2013.01); *B25D 17/02* (2013.01); *E21B 10/36* (2013.01); *E21B 10/567* (2013.01);
(Continued)

(58) Field of Classification Search
CPC ..... E21B 10/56; E21B 10/46; E21B 10/36; E21B 10/567; E21B 10/5673; E21B 2010/561; E21B 2010/566; B25D 17/02
See application file for complete search history.

(56) References Cited

U.S. PATENT DOCUMENTS 4,694,918 A 9/1987 Hall
5,304,342 A * 4/1994 Hall, Jr. ..... B01J 3/062 419/11
(Continued)

FOREIGN PATENT DOCUMENTS

CN 102076884 A 5/2011
CN 102165081 A 8/2011
(Continued)

OTHER PUBLICATIONS

International Search Report dated Feb. 16, 2016 for the corresponding PCT Application No. PCT/JP2015/083276.
(Continued)

*Primary Examiner* — Yong-Suk Ro
(74) *Attorney, Agent, or Firm* — Leason Ellis LLP

(57) ABSTRACT

A drill bit button insert is attached to a button inserts mounted in a drill bit and performs a drilling. The drill bit button insert includes a tip body and an abrasive layer that is formed of a diamond sintered body harder than the tip body and is coated at least at the button insert working surface of the tip body. The abrasive layer has two or more high hardness layers and a low hardness layer having a hardness lower than that of the high hardness layers disposed between the high hardness layers. The high hardness layers and the low hardness layer are provided from the surface side of the abrasive layer toward the tip body side.

4 Claims, 2 Drawing Sheets

(51) Int. Cl.
*E21B 10/567* (2006.01)
*E21B 10/36* (2006.01)

(52) U.S. Cl.
CPC .... *E21B 10/5673* (2013.01); *E21B 2010/561* (2013.01); *E21B 2010/566* (2013.01)

(56) References Cited

U.S. PATENT DOCUMENTS

| | | | | |
|---|---|---|---|---|
| 5,871,850 | A * | 2/1999 | Moriguchi | C23C 28/04 407/119 |
| 5,882,777 | A * | 3/1999 | Kukino | C04B 41/009 407/119 |
| 6,220,375 | B1 * | 4/2001 | Butcher | B22F 7/06 175/428 |
| 6,315,065 | B1 | 11/2001 | Yong et al. | |
| 6,779,951 | B1 * | 8/2004 | Vale | B22F 7/06 407/119 |
| 8,292,006 | B2 | 10/2012 | Scott et al. | |
| 8,573,330 | B2 | 11/2013 | Mourik et al. | |
| 8,695,733 | B2 | 4/2014 | Fang et al. | |
| 9,097,111 | B2 | 8/2015 | Jonker et al. | |
| 2006/0191723 | A1 | 8/2006 | Keshavan | |
| 2009/0152018 | A1 * | 6/2009 | Sani | B21C 3/02 175/432 |
| 2011/0132667 | A1 * | 6/2011 | Smallman | B01J 3/062 175/428 |
| 2012/0241226 | A1 | 9/2012 | Bertagnolli et al. | |
| 2013/0015001 | A1 | 1/2013 | Bertagnolli et al. | |
| 2014/0060937 | A1 | 3/2014 | Konovalov et al. | |
| 2014/0361601 | A1 * | 12/2014 | Bush | E21B 10/56 299/105 |

FOREIGN PATENT DOCUMENTS

| | | | |
|---|---|---|---|
| JP | 63-295482 | A | 12/1988 |
| JP | 4676700 | B | 4/2011 |
| JP | 2013-513031 | A | 4/2013 |
| WO | WO-2011/069637 | A | 6/2011 |
| WO | WO-2013/064433 | A | 5/2013 |

OTHER PUBLICATIONS

Extended European Search Report dated Jul. 3, 2018 for the corresponding European Patent Application No. 15864189.4.
Office Action dated Jul. 26, 2018 for the corresponding Chinese Patent Application No. 201580064114.5.

* cited by examiner

DRILL BIT BUTTON INSERT AND DRILL BIT

CROSS-REFERENCE TO RELATED PATENT APPLICATIONS

This application is a U.S. National Phase Application under 35 U.S.C. § 371 of International Patent Application No. PCT/JP2015/083366 filed on Nov. 27, 2015 and claims the benefit of Japanese Patent Applications No. 2014-240087, filed on Nov. 27, 2014, and No. 2015-230103, filed on Nov. 25, 2015, all of which are incorporated herein by reference in their entirety. The International Application was published in Japanese on Jun. 2, 2016 as International Publication No. WO/2016/084914 under PCT Article 21(2).

FIELD OF THE INVENTION

The present invention relates to a drill bit button insert that is attached to a button inserts mounted in a drill bit and that performs a drilling, and to the drill bit in which such a drill bit button insert is attached to the button inserts mounted in the drill bit.

BACKGROUND OF THE INVENTION

As a drill bit button insert that is attached to a button inserts mounted in a drill bit and that performs a drilling, there is disclosed a drill bit button insert in which an abrasive layer formed of a sintered body of polycrystalline diamond which is harder than a tip body is coated on the button insert working/cutting surface of the tip body formed of a cemented carbide. Here, in U.S. Pat. Nos. 4,694,918, 8,573,330, 8,695,733, 8,292,006 and Japanese Patent No. 4676700, drill bit button inserts formed of an abrasive layer as a multilayer structure are mainly proposed for relieving stress in the polycrystalline diamond sintered body. The multilayer structure has a slope so that hardness is decreased and toughness is increased from the outermost layer on the surface of the abrasive layer toward the tip body side.

Generally, the outermost layer of such an abrasive layer of the multilayer structure is a polycrystalline diamond sintered body of a composition sintered by adding Co or the like as a metal binder (metal catalyst) to diamond particles. In addition, in an inner layer, the content of diamond is decreased and metal carbide such as WC is added instead, so that the toughness is enhanced, while maintaining higher hardness than the tip body. It is proposed that the inner layer has a further multilayer structure, and as closed to the inner layer, the diamond content is decreased and the WC content is increased to give the slope in hardness and toughness.

Technical Problem

Incidentally, in a drilling operation by a drill bit to which such a drill bit button insert is attached, for example, tens or more of drilling holes with a depth of several meters are drilled on one rock surface, and explosives are charged in these drilling holes to be blasted so that large drilling holes are formed. Accordingly, in order to improve the efficiency of the drilling operation, when ten or more drilling holes on one surface are drilled, a drill bit with a long life which does not require exchange in the middle is required.

However, in the drill bit button insert having an abrasive layer of a multilayer structure as described above, if the drill bit button insert suddenly hits an extremely hard ultra-hard rock or the like among the rocks during drilling, and damage or chipping occurs in a polycrystalline diamond sintered body layer of the outermost layer, the hardness of the inside of the abrasive layer is decreased and the relatively soft layer is exposed. If the inside of the abrasive layer is exposed in that manner, wear rapidly progresses from the exposed portion and the wear reaches a tip body, and thus drilling becomes impossible and the life of the drill bit is expended.

The present invention is made under such circumstances, and provides a drill bit button insert capable of maintaining drilling performance without causing wear to immediately reach a tip body even if damage or chipping occurs in the outer layer at the time of drilling. In addition, an object is to provide a drill bit having a long life to which such a drill bit button insert is attached.

SUMMARY OF THE INVENTION

Solution to Problem

In order to solve the above problem and to achieve such an object, a drill bit button insert that is one embodiment of the present invention, is attached to a button inserts mounted in a drill bit, and performs a drilling, includes a tip body and an abrasive layer formed of a diamond sintered body harder than the tip body coated at least at the button insert working/cutting surface of the tip body, in which the abrasive layer has at least two high hardness layers and a low hardness layer having a hardness lower than that of the high hardness layer disposed between the high hardness layers from the surface side of the abrasive layer toward the tip body side.

In the drill bit button insert configured in this manner, since the abrasive layer formed of the diamond sintered body coated at the button insert working/cutting surface of the tip body has at least two high hardness layers and the low hardness layer having a hardness lower than that of the high hardness layer disposed between these high hardness layers from the surface side of the abrasive layer toward the tip body side, that is, from the outer layer side toward the inner side of the abrasive layer, even if damage and chipping occur in the high hardness layer on the outer layer side during the drilling to expose the inside, and the low hardness layer of the inner side wears out from this exposed portion, the progress of wear can be suppressed by the high hardness layer on the tip body side located at the inner side of the low hardness layer.

Therefore, according to the drill bit button insert of the above-described configuration, it is possible to prevent the wear generated in the abrasive layer from rapidly progressing to reach the tip body, and to maintain the drilling performance of the drill bit button insert by the high hardness layer of the inner side. Accordingly, in the drill bit of the present invention in which such a drill bit button insert is attached to button inserts mounted in a drill bit, the life thereof can be extended so that it is not required to replace the drill bit button insert while drilling a plurality of drilling holes and it is possible to promote efficiency of the drilling operation.

In addition, in the abrasive layer, a plurality of high hardness layers and low hardness layers are alternately disposed from the surface side of the abrasive layer toward the tip body side. Therefore, even for the high hardness layer of the inner side, it is possible to relieve the stress by the low hardness layer, which is disposed on the further inner side of the high hardness layer and has a hardness lower and a toughness higher than that of the high hardness layer. Furthermore, if three or more high hardness layers are alternately disposed with the low hardness layer, it is possible to prolong the life of the drill bit button insert according to the number of layers of the high hardness layer.

Here, it is desirable that the thickness of the high hardness layer is set to be in a range of ½ or more of the thickness of the low hardness layer, and of the thickness of the low hardness layer or less. The thickness of the high hardness layer is set to be ½ or more of the thickness of the low hardness layer so that it is possible to cause the thickness of the low hardness layer to be relatively twice or less of that of the high hardness layer. Therefore, when the damage or the like occurs in the high hardness layer of the outer layer, it is possible to ensure the drilling length and time until the wear reaches the high hardness layer of the inner side. However, if the thickness of the high hardness layer is thicker than that of the low hardness layer, there is a possibility that the stress of the high hardness layer cannot be sufficiently relieved.

In addition, specifically, it is desirable that each of the thickness of high hardness layer and the thickness of the low hardness layer is 150 μm or more at the thinnest portion, and 800 μm or less at the thickest portion, respectively. In both the high hardness layer and the low hardness layer, in a case where the thickness of the thinnest portion is less than 150 μm, it is difficult to uniformly form the layer so that there is a possibility that sufficient wear resistance cannot be obtained. On the other hand, in a case where the thickness of the thickest portion exceeds 800 μm, when the high hardness layer of the outer layer is damaged at this portion and the low hardness layer of the inner side thereof wears out, the surface of the abrasive layer is largely peeled off and the shape of the button insert working/cutting surface of the drill bit button insert becomes distorted so that there is a possibility that desired drilling performance cannot be obtained.

As described above, the high hardness layer may be a layer of a polycrystalline diamond sintered body sintered by adding a metal binder (metal catalyst) such as Co to diamond particles, and the low hardness layer may be a layer formed of a diamond sintered body to which particles such as metal carbide or metal nitride are added by decreasing the content of diamond particles. In addition, in both the high hardness layer and the low hardness layer, as the diamond sintered body layer sintered by containing diamond particles, metal binder, and additive particles such as metal carbide, metal nitride, metal carbonitride and the like, the hardness may be decreased by adjusting the content and particle diameter of the diamond particles, and the content, type, composition ratio and the like of the additive particles such as metal binder and metal carbide in the high hardness layer and the low hardness layer.

Furthermore, by adjusting the hardness in this manner, an intermediate layer having a hardness lower than that of the high hardness layer and a hardness higher than that of the low hardness layer may be disposed from the surface side of the abrasive layer toward the tip body side between the high hardness layer and the low hardness layer. By providing such an intermediate layer, stress relief of the high hardness layer on the outer layer side is maintained, and even when the damage or the like occurs in the high hardness layer, it is possible to ensure the drilling performance until the wear reaches the low hardness layer.

Advantageous Effects of Invention

As described above, according to the present invention, even if the drill bit button insert suddenly hits an extremely hard ultra-hard rock or the like among the rocks during drilling, and damage or chipping occurs in the high hardness layer of the outer layer of the abrasive layer and the wear progresses from the exposed portion to the low hardness layer of the inner side, it is possible to prevent the wear from reaching the tip body at once and to maintain the drilling performance so that it is possible to extend the life of the drill bit and to achieve the efficient drilling operation.

DETAILED DESCRIPTION OF THE INVENTION

Figure 1:
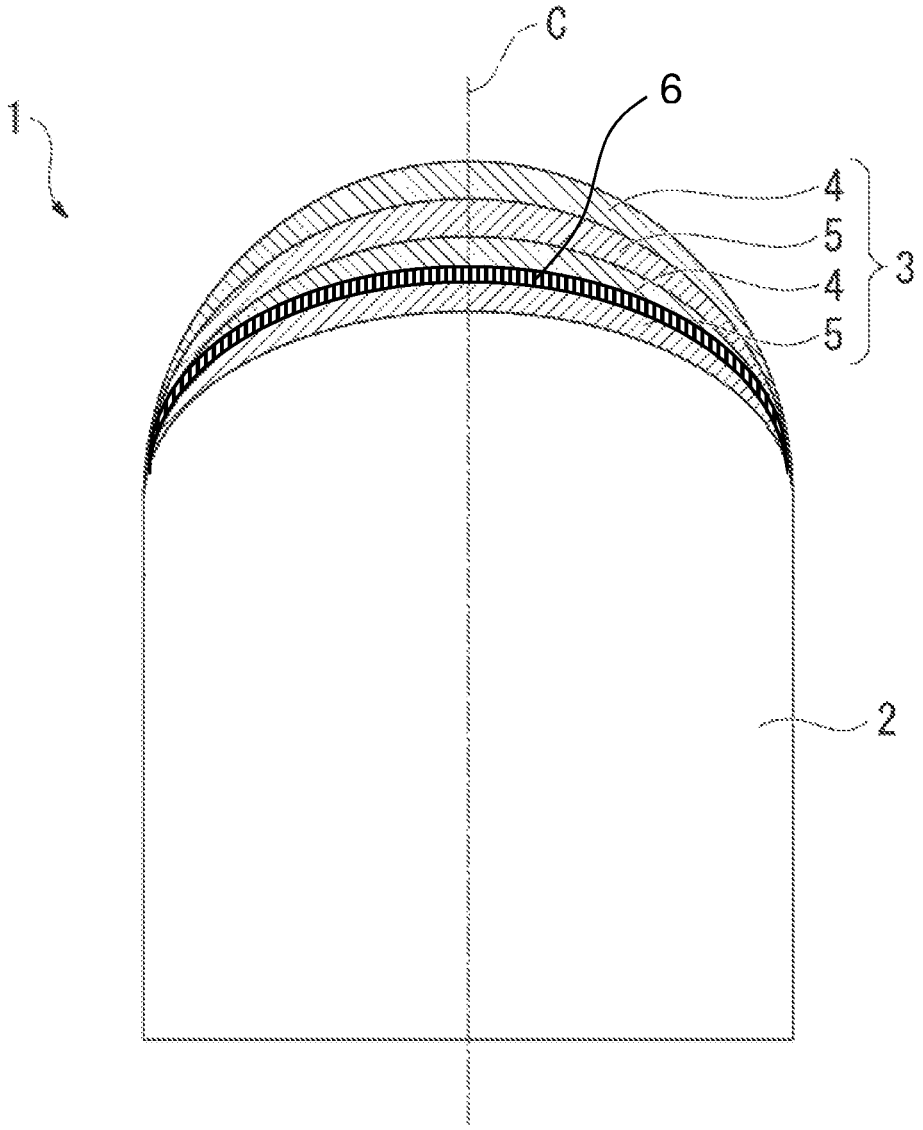
FIG. 1 is a cross-sectional view showing an embodiment of a drill bit button insert of the present invention.
Figure 2:
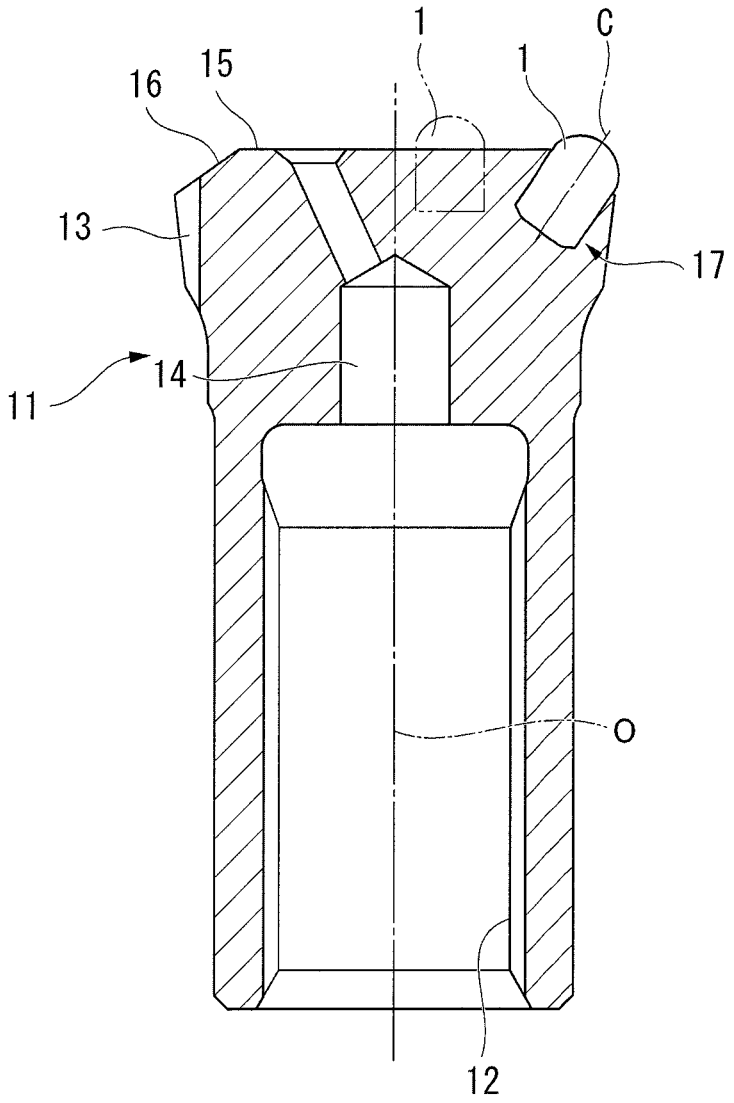
FIG. 2 is a cross-sectional view showing an embodiment of a drill bit of the present invention in which the drill bit button insert of the embodiment shown in FIG. 1 is attached to a button inserts mounted in a drill bit.

FIG. 1 is a cross-sectional view showing an embodiment of a drill bit button insert 1 of the present invention. FIG. 2 is a cross-sectional view showing an embodiment of a drill bit of the present invention to which the drill bit button insert 1 of the embodiment is attached. The drill bit button insert 1 of the present embodiment is provided with a tip body 2 formed of a hard material such as a cemented carbide or the like and an abrasive layer 3 formed of a diamond sintered body harder than the tip body 2 and coated on a button insert working/cutting surface of the tip body 2 (upper portion in FIG. 1).

In the tip body 2, a rear end portion thereof (lower portion in FIG. 1) has a columnar shape centered on a tip center line C, the button insert working/cutting surface has a hemispherical shape having a center on the tip center line C at a radius equal to the radius of the cylinder formed by the rear end portion, and an outer diameter from the tip center line C gradually decreases toward the tip end side. That is, the drill bit button insert 1 of the present embodiment is a button tip.

The drill bit in which the drill bit button insert 1 is attached to the button inserts mounted in the drill bit has a bit body 11 formed of steel or the like and having a substantially bottomed cylindrical shape centered on an axis O as shown in FIG. 2, and the bottomed portion thereof is the button inserts mounted in the drill bit (upper portion in FIG. 2) to which the drill bit button insert 1 is attached.

In addition, a female threaded portion 12 is formed on the inner periphery of the cylindrical rear end portion (lower portion in FIG. 2), and a drill rod connected to a drilling device is screwed into the female threaded portion 12 to transmit a striking force and a thrust toward the tip end side in the direction of the axis O and a rotating force around the axis O. In this manner, the rock is crushed by the drill bit button insert 1 to form a drilling hole.

The button inserts mounted in the drill bit of the bit body 11 has a slightly larger outer diameter than the rear end portion, a plurality of discharge grooves 13 extending in parallel with the axis O are formed on the outer periphery of the button inserts mounted in the drill bit with an interval in the circumferential direction, and the crushed chips generated by the rock crushing by the drill bit button insert 1 is discharged to the rear end side through the discharge groove 13. In addition, a blow hole 14 is formed along the axis O from the bottom surface of the female threaded portion 12 of the bit body 11 having a bottom. The blow hole 14 diagonally branches at the button inserts mounted in the drill bit of the bit body 11, opens to a tip end surface of the bit body 11, and ejects a fluid such as compressed air supplied via the drill rod to promote discharge of crushed chips.

Furthermore, the tip end surface of the bit body 11 is provided with a circular face surface 15 centered on the axis O perpendicular to the axis O on the inner periphery side, and a truncated cone-shaped gauge surface 16 which is located on the outer periphery of the face surface 15 and which faces the rear end side toward the outer peripheral side. The blow hole 14 opens to the face surface 15 and the tip end of the discharge groove 13 opens to the gauge surface 16.

On the face surface 15 and the gauge face 16, a plurality of attachment holes 17 having a circular cross section are formed so as to avoid opening portions of the blow hole 14 and the discharge groove 13, respectively. In the drill bit button insert 1, the cylindrical rear end portion thereof is fixed by being tightly fitted or brazed to the attachment hole 17 by press fitting, shrink fitting or the like, and is attached so that the tip center line C is perpendicular to the face surface 15 and the gauge surface 16.

In the drill bit button insert 1 attached to the button inserts mounted in the drill bit in this manner, the abrasive layer 3 coated on the button insert working/cutting surface has at least two high hardness layers 4 and a low hardness layer 5 having a hardness lower than that of the high hardness layer 4 disposed between these high hardness layers 4 from a surface side of the abrasive layer 3 toward the tip body 2 side. Furthermore, in the present embodiment, the low hardness layer 5 is disposed between the high hardness layer 4 on the tip body 2 side and the tip body 2, and a plurality of two high hardness layers 4 and two low hardness layers 5 are alternately disposed in this order from the surface of the abrasive layer 3 toward the surface of the tip body 2.

Among these, the high hardness layer 4 is a layer of a polycrystalline diamond sintered body sintered by only adding a metal binder (metal catalyst) such as Co, Ni or Fe—Ni alloy to diamond particles. On the other hand, the low hardness layer 5 reduces the content of diamond particles with respect to the high hardness layer 4, and is a sintered body layer sintered by adding metal carbide particles such as WC, TaC and TiC, metal nitride particles such as TiN and cBN, metal carbonitride particles such as TiCN, and a metal binder as described above. In this manner, the hardness of the low hardness layer 5 can be reduced than that of the high hardness layer 4. In a case of being prepared in this manner, the Vickers hardness of the high hardness layer 4 is in a range of approximately 2500 to 4000, and the Vickers hardness of the low hardness layer 5 is in a range of approximately 1500 to 2500.

Furthermore, both the high hardness layer 4 and the low hardness layer 5 may be sintered body layers sintered by containing diamond particles, the above-described metal binder and additive particles such as metal carbide, metal nitride, metal carbonitride and the like. Among these, in the low hardness layer 5, the content and particle diameter of the diamond particles are decreased and the content, type, composition ratio, and the like of the additive particles such as metal carbide are adjusted so that the hardness can be reduced than that of the high hardness layer 4. Sintering of the drill bit button insert 1 in which such an abrasive layer 3 is coated on the button insert working/cutting surface of the tip body 2 is basically performed in a diamond stable region and, for example, is possible by known sintering methods as described in U.S. Pat. Nos. 4,694,918, 8,573,330, 8,695,733, 8,292,006 and Japanese Patent No. 4676700.

In the drill bit button insert 1 having such a configuration and the drill bit in which the drill bit button insert 1 is attached to the button inserts mounted in the drill bit, in a case where the drill bit button insert 1 suddenly hits extremely ultra-hard rock or the like among the rocks during the drilling, the damage or chipping occurs in the outermost first high hardness layer 4 among the abrasive layers 3 coated on at least the button insert working/cutting surface of the tip body 2 to expose the inside of the abrasive layer 3. In this manner, the low hardness layer 5 of the inner side is worn out, but the second high hardness layer 4 having a hardness higher than that of the low hardness layer 5 is disposed on the further inner side of the low hardness layer 5. Therefore, it can be suppressed by the second high hardness layer 4 that the wear rapidly progresses until reaching the tip body 2.

Accordingly, even after the low hardness layer 5 between the first and second high hardness layers 4 wears out due to the progress of the wear, the drilling can be continued by the tip body 2 side of the abrasive layer 3, that is, the second high hardness layer 4 of the inner side so that the drilling performance can be maintained. Therefore, according to the drill bit in which such a drill bit button insert 1 is attached to the button inserts mounted in the drill bit, the life of the drill bit can be prolonged. Even in a case of forming tens or more of drilling holes of several meters on the one surface of the rock, it is not required to exchange drilling bits in the middle and it is possible to perform an efficient drilling operation.

In addition, between these first and second high hardness layers 4, since the low hardness layer 5 having a hardness lower, but a toughness higher than that of the high hardness layer 4 is interposed, even in a case where the high hardness layer 4 is specifically a polycrystalline diamond sintered body sintered by adding only the metal binder to the diamond particles, the residual stress generated in the high hardness layer 4 can be relieved. In addition, in the present embodiment, a plurality of layers (two layers) of the high hardness layer 4 and the low hardness layer 5 are alternately disposed from the surface side of the abrasive layer 3 toward the tip body 2 side. Therefore, the stress of the second high hardness layer 4 of the inner side can be relieved by the low hardness layer 5 interposed between the inner sides thereof, that is, the second high hardness layer 4 and the tip body 2.

In the embodiment, although the high hardness layer 4 and the low hardness layer 5 of two layers are alternately disposed from the surface side of the abrasive layer 3 toward the tip body 2 side in this manner, in the abrasive layer 3, at least two high hardness layers 4 and one low hardness layer 5 disposed therebetween may be provided. That is, the second high hardness layer 4 closest to the tip body 2 may be directly coated on the button insert working/cutting surface of the tip body 2. In addition, three or more high hardness layers 4 may be alternately disposed with the low hardness layer 5 interposed therebetween, for example, it may be even numbers of the abrasive layers 3 in which the same number of high hardness layers 4 and low hardness layers 5 are alternately stacked, and it may be odd numbers of the abrasive layers 3 in which the outermost layer and the innermost layer are the high hardness layers 4 and the low hardness layers 5 are disposed between each of the high hardness layers 4. In the abrasive layer 3, two to six high hardness layers 4 and low hardness layers 5 may be alternately disposed from the surface side of the abrasive layer 3 toward the tip body 2 side. The total number of layers of the high hardness layer and the low hardness layer may be 4 layers or more and 12 layers or less.

Furthermore, an intermediate layer 6 having a hardness lower than that of the high hardness layer 4 and higher than that of the low hardness layer 5 may be disposed between the high hardness layer 4 and the low hardness layer 5 from the surface side of the abrasive layer 3 toward the tip body 2 side. For example, in a case where the high hardness layer 4 is a polycrystalline diamond sintered body layer sintered by adding only a metal binder to diamond particles, the content and particle diameter of the diamond particles, and the content, type, composition ratio, or the like of the additive particles such as metal binder and metal carbide are adjusted, so that the intermediate layer 6 having a hardness higher than that of the low hardness layer 5 and lower than that of the high hardness layer 4 may be disposed between the high hardness layer 4 and the low hardness layer 5.

Since in such an intermediate layer 6, the hardness can be decreased and the toughness can be increased for the high hardness layer 4 on the outer layer side, the stress of the high hardness layer 4 can be relieved to some extent. On the other hand, since the hardness is high for the low hardness layer 5 on the inner layer side, when the damage or chipping occurs in the high hardness layer 4, the drilling performance can be maintained until the wear reaches the low hardness layer 5. As a result, it is possible to extend the life of the drill bit button insert 1. The intermediate layer 6 itself may be formed of a plurality of layers whose hardness gradually decreases from the surface side of the abrasive layer 3 toward the tip body 2, that is, from the outer layer side toward the inner layer side.

Here, it is desirable that the thickness of each high hardness layer 4 is in a range of ½ or more of the thickness of the low hardness layer 5 and of the thickness of the low hardness layer 5 or less. If the thickness of the high hardness layer 4 is not larger than the thickness of the low hardness layer 5, this low hardness layer 5 is sufficient to relieve the stress of the high hardness layer 4. In addition, if the thickness of the high hardness layer 4 is ½ or more of the thickness of the low hardness layer 5, since the thickness of the low hardness layer 5 is relatively twice or less of the thickness of the high hardness layer 4, the stress relief of the high hardness layer 4 can be more reliably achieved. Furthermore, as the thickness of the low hardness layer 5 is obtained in this manner, it is possible to ensure a drilling length and time until the wear reaches the high hardness layer 4 on the inner side of the low hardness layer 5 and the tip body 2 due to the low hardness layer 5 harder than the tip body 2, even at low hardness.

More specifically, it is desirable that the thickness of each high hardness layer 4 and the thickness of the low hardness layer 5 are 150 μm or more at the thinnest portion and 800 μm or less at the thickest portion, respectively. In each of the high hardness layer 4 and the low hardness layer 5, if the thickness of the thinnest portion is less than 150 μm, it is difficult to cause the thickness uniform in a case where the high hardness layer 4 and the low hardness layer 5 are sintered body layers containing diamond particles as described above so that there is a possibility that sufficient wear resistance cannot be obtained. In addition, if the thickness of the thickest portion exceeds 800 μm, when the high hardness layer 4 is damaged in the thickest portion and the low hardness layer 5 wears out, the surface of the abrasive layer 3 largely peels off and the shape of the button insert working/cutting surface of the drill bit button insert 1 is distorted so that there is a possibility that desired drilling performance cannot be obtained. This is the same as the intermediate layer.

It is desirable that the total thickness of the abrasive layer 3 is in the range of 450 μm to 2500 μm. If the thickness of the entire abrasive layer 3 is less than 450 μm, even in a case where the abrasive layer 3 is formed by the two high hardness layers 4 and the one low hardness layer 5 having the smallest number of layers, a portion where the thickness of the thinnest portion is less than 150 μm occurs in any layer as described above, and the absolute thickness of the abrasive layer 3 is too thin and wears out immediately so that there is a possibility that it is not possible to form the drilling hole with a necessary drilling length. On the other hand, if the thickness of the abrasive layer 3 exceeds 2500 μm, in a case where the high hardness layer 4 and the low hardness layer 5 are the diamond sintered body layers, even if the stress is relieved due to the low hardness layer 5, there is a possibility that cracking is likely to occur in the entire drill bit button insert 1 due to residual stress.

In the drill bit button insert 1 of the present embodiment, the case where the present invention is applied to a button type drill bit button insert in which the button insert working/cutting surface of the tip body 2 has a hemispherical shape is described above. However, it is possible to apply the present invention to a so-called ballistic type drill bit button insert in which the button insert working/cutting surface of the tip body has a shell shape, and to a so-called spike type drill bit button insert in which the rear end side of the button insert working/cutting surface has a conical surface shape and decreases in diameter toward the tip end side, and a tip end has a spherical shape with a smaller radius than the cylindrical rear end portion of the tip body.

EXAMPLES

Next, the effect of the drill bit button insert and the drill bit of the present invention will be demonstrated with reference to examples. In the example, five types of button type drill bit button inserts with 11 mm diameter of a hemispherical formed by a button insert working/cutting surface were manufactured. The drill bit button insert was coated with varying particle diameters and volume contents of diamond particles and additive particles such as metal carbide in the high hardness layer and the low hardness layer of the abrasive layer (in the intermediate layer in Example 3), compositions and addition ratios of metal binder, and number of layers and thickness of each layer. These were designated as Examples 1 to 5. Similarly to the methods described in U.S. Pat. Nos. 4,694,918, 8,573,330, 8,695,733, 8,292,006 and Japanese Patent No. 4676700, all of the sintering of the examples was performed by using an ultra-high pressure and high temperature generator, at a pressure of 5.8 GPa, a temperature of 1500° C., and a sintering time of 10 minutes which were a stable region of diamond.

In Example 1, a high hardness layer was formed to a thickness of 200 μm with a mixture containing 30 vol % of diamond particles having a particle diameter of 2 to 4 μm, 70 vol % of diamond particles having a particle diameter of 20 to 40 μm and 15 vol % (content ratio with respect to the entire layer containing particles. hereinafter, the same as above.) of metal binder of Ni: 100 wt % without containing additive particles. In addition, a low hardness layer was formed to a thickness of 400 μm with a mixture containing 60 vol % of diamond particles having a particle diameter of 4 to 6 μm, 40 vol % of TaC particles having a particle diameter of 0.5 to 2 μm as additive particles, and 10 vol % of a metallic binder of Co: 100 wt %. A button insert working/cutting surface was coated with an abrasive layer in which these layers were alternately disposed in respective three layers from a surface side toward a tip body side.

In Example 2, a high hardness layer was formed to a thickness of 150 μm with a mixture containing 100 vol % of diamond particles having a particle diameter of 10 to 20 μm and 10 vol % of metal binder of Co: 100 wt % without containing additive particles. In addition, a low hardness layer was formed to a thickness of 200 μm with a mixture containing 50 vol % of diamond particles having a particle diameter of 4 to 6 μm, 50 vol % of WC particles having a particle diameter of 0.5 to 2 μm as additive particles, and 15 vol % of a metallic binder of Co: 100 wt %. A button insert working/cutting surface was coated with an abrasive layer in which these layers were alternately disposed in respective six layers from a surface side toward a tip body side.

In Example 3, a high hardness layer was formed to a thickness of 200 μm with a mixture containing 30 vol % of diamond particles having a particle diameter of 0.5 to 2 μm, 70 vol % of diamond particles having a particle diameter of 4 to 6 μm and 10 vol % of metal binder of Co: 100 wt % without containing additive particles. An intermediate layer was formed to a thickness of 200 μm with a mixture containing 60 vol % of diamond particles having a particle diameter of 4 to 6 μm, 40 vol % of WC particles having a particle diameter of 0.5 to 2 μm as additive particles, and 5 vol % of a metallic binder of Co: 100 wt %. A low hardness layer was formed to a thickness of 200 μm with a mixture containing 20 vol % of diamond particles having a particle diameter of 4 to 6 μm, 80 vol % of WC particles having a particle diameter of 0.5 to 2 μm as additive particles, and 5 vol % of a metallic binder of Co: 100 wt %. A button insert working/cutting surface was coated with an abrasive layer in which these layers were alternately disposed in respective two layers from a surface side toward a tip body side.

In Example 4, a high hardness layer was formed to a thickness of 400 μm with a mixture containing 65 vol % of diamond particles having a particle diameter of 15 to 30 μm, 35 vol % of TiC particles having a particle diameter of 0.5 to 1.3 μm as additive particles, and 15 vol % of metal binder of Co: 100 wt %. In addition, a low hardness layer was formed to a thickness of 800 μm with a mixture containing 30 vol % of diamond particles having a particle diameter of 15 to 30 μm, 70 vol % of TiCN particles having a particle diameter of 0.5 to 2 μm as additive particles, and 10 vol % of a metallic binder of Co: 100 wt %. A button insert working/cutting surface was coated with an abrasive layer in which these layers were alternately disposed in respective two layers from a surface side toward a tip body side.

In Example 5, a high hardness layer was formed to a thickness of 200 μm with a mixture containing 80 vol % of diamond particles having a particle diameter of 6 to 12 μm, 20 vol % of WC particles having a particle diameter of 2 to 4 μm as additive particles, and containing 15 vol % of metal binder of Fe: 69 wt %, Ni: 31 wt %. In addition, a low hardness layer was formed to a thickness of 300 μm with a mixture containing 40 vol % of diamond particles having a particle diameter of 15 to 30 μm, 60 vol % of cBN particles having a particle diameter of 2 to 4 μm as additive particles, and 10 vol % of a metallic binder of Co: 100 wt %. A button insert working/cutting surface was coated with an abrasive layer in which these layers were alternately disposed in respective two layers from a surface side toward a tip body side.

On the other hand, as comparative examples to these Examples 1 to 5, four types of button type drill bit button inserts with 11 mm diameter of a hemisphere formed by a button insert working/cutting surface coated with an abrasive layer not having a low hardness layer between the two high hardness layers were manufactured. These were designated as Comparative Examples 1 to 4. Similarly to the examples, all of the sintering of the comparative examples was performed by using an ultra-high pressure and high temperature generator, at a pressure of 5.8 GPa, a temperature of 1500° C., and a sintering time of 10 minutes which were a stable region of diamond.

In Comparative Example 1, a high hardness layer was formed to a thickness of 200 μm with a mixture containing 30 vol % of diamond particles having a particle diameter of 0.5 to 2 μm, 70 vol % of diamond particles having a particle diameter of 4 to 6 μm and 10 vol % of metal binder of Co: 100 wt % without containing additive particles. In addition, an intermediate layer was formed to a thickness of 400 μm with a mixture containing 60 vol % of diamond particles having a particle diameter of 4 to 6 μm, 40 vol % of WC particles having a particle diameter of 0.5 to 2 μm as additive particles, and 5 vol % of a metallic binder of Co: 100 wt %. Furthermore, a low hardness layer was formed to a thickness of 600 μm with a mixture containing 20 vol % of diamond particles having a particle diameter of 4 to 6 μm, 80 vol % of WC particles having a particle diameter of 0.5 to 2 μm as additive particles, and 5 vol % of a metallic binder of Co: 100 wt %. A button insert working/cutting surface was coated with an abrasive layer in which these layers were disposed in only respective one layer in order from a surface side toward a tip body side.

In Comparative Example 2, a hardness layer was coated with only one layer having a thickness of 800 μm with a mixture containing 30 vol % of diamond particles having a particle diameter of 0.5 to 2 μm, 70 vol % of diamond particles having a particle diameter of 4 to 6 μm and 10 vol % of metal binder of Co: 100 wt % without containing additive particles.

In Comparative Example 3, a high hardness layer was formed to a thickness of 400 μm with a mixture containing 30 vol % of diamond particles having a particle diameter of 0.5 to 2 μm, 70 vol % of diamond particles having a particle diameter of 4 to 6 μm and 10 vol % of metal binder of Co: 100 wt % without containing additive particles. In addition, a low hardness layer was formed to a thickness of 600 μm with a mixture containing 60 vol % of diamond particles having a particle diameter of 4 to 6 μm, 40 vol % of WC particles having a particle diameter of 0.5 to 2 μm as additive particles, and 5 vol % of a metallic binder of Co: 100 wt %. A button insert working/cutting surface was coated with an abrasive layer in which these layers were disposed in only respective one layer in order from a surface side toward a tip body side.

In Comparative Example 4, a high hardness layer was formed to a thickness of 400 μm with a mixture containing 30 vol % of diamond particles having a particle diameter of 0.5 to 2 μm, 70 vol % of diamond particles having a particle diameter of 4 to 6 μm and 10 vol % of metal binder of Co: 100 wt % without containing additive particles. In addition, a low hardness layer was formed to a thickness of 600 μm with a mixture containing 20 vol % of diamond particles having a particle diameter of 4 to 6 μm, 80 vol % of WC particles having a particle diameter of 0.5 to 2 μm as additive particles, and 5 vol % of a metallic binder of Co: 100 wt %. A button insert working/cutting surface was coated with an abrasive layer in which these layers were disposed in only respective one layer in order from a surface side toward a tip body side.

The drill bit button inserts (button tips) of Examples 1 to 5 and Comparative Examples 1 to 4 manufactured in this manner were attached seven in total of five to the gauge surface and two to the face surface of the drill bit with a bit diameter of 45 mm. The drilling operation was performed to drill the drilling holes with a drilling length of 4 m in a copper mine with an average uniaxial compressive strength of 180 MPa including hard rock and ultra-hard rock using these, the total drilling length (m) until the drill bit button insert reached the end of life was measured and the wear form of the drill bit button insert at the end of drilling was checked. Drilling conditions were a drilling device of model No. H205D manufactured by TAMROCK, a striking pressure of 160 bars, a feed pressure of 80 bars, and a rotational pressure of 55 bars. In addition, water was supplied from the blow hole and the water pressure was 18 bars. The results are shown in Table 1.

TABLE 1

| | Total drilling length | Wear form |
|---|---|---|
| Example 1 | 368 (m) | Normal wear |
| Example 2 | 424 (m) | Normal wear |
| Example 3 | 236 (m) | Normal wear |
| Example 4 | 382 (m) | Normal wear |
| Example 5 | 332 (m) | Normal wear |
| Comparative Example 1 | 112 (m) | Normal wear and partial chipping |
| Comparative Example 2 | 40 (m) | Layer separation |
| Comparative Example 3 | 88 (m) | Normal wear and partial chipping |
| Comparative Example 4 | 84 (m) | Normal wear and partial chipping |

From these results, in the drill bits to which the drill bit button inserts of Comparative Examples 1 to 4 were attached, partial chipping occurred in the drill bit button insert in addition to normal wear even in Comparative Example 1 having the longest drilling length, and the drill bits reached the end of life with a drilling length of approximately ½ of the drill bits to which the drill bit button inserts of Examples 1 to 5 were attached. Specifically, in Comparative Example 2 in which the abrasive layer was one layer, the drill bits reached the end of life when 10 holes were drilled by layer separation, and it was not possible to form a sufficient number of drilling holes on one surface of the rock with one drill bit.

On the other hand, in the drill bits to which the drill bit button inserts of Examples 1 to 5 were attached, it is possible to form drilling holes of approximately 60 holes even in Example 3 having the shortest total drilling length. In a case of forming ten or more drilling holes on one rock surface, efficient drilling was possible without replacing the drill bits for approximately three surfaces. Specifically, in Example 2 in which the number of layers of the high hardness layer was large, it was possible to form the drilling holes of 100 holes or more, and to perform an extremely efficient drilling operation.

When trying to manufacture a drill bit button insert having an abrasive layer in which a high hardness layer and a low hardness layer are alternately stacked in respective two layers, with the same composition of high hardness layer and low hardness layer as in Example 1, with 1000 μm of the thickness of the high hardness layer, and with 200 μm of the thickness of the low hardness layer, the thickness of the high hardness layer exceeded 800 μm, the residual stress of the high hardness layer in the abrasive layer was high, and interlayer cracking occurred in the high hardness layer at the time of sintering so that the drill bit button insert could not be manufactured.

INDUSTRIAL APPLICABILITY

As described above, according to the present invention, even if the drill bit button insert suddenly hits an extremely hard ultra-hard rock or the like among the rocks during drilling, and damage or chipping occurs in the high hardness layer of the outer layer of the abrasive layer and the wear progresses from the exposed portion to the low hardness layer of the inner side, it is possible to prevent the wear from reaching the tip body at once and to maintain the drilling performance so that it is possible to extend the life of the drill bit and to achieve an efficient drilling operation.

REFERENCE SIGNS LIST

1. Drill bit button insert
2. Tip body
3. Abrasive layer
4. High hardness layer
5. Low hardness layer
11. Bit body
C. Tip center line
O. Axis of bit body 11

The invention claimed is:

1. A drill bit button insert that is attached to a button inserts mounted in a drill bit and performs a drilling, comprising:

a tip body; and an abrasive layer formed of a diamond sintered body harder than the tip body coated at least at a button insert working surface of the tip body, wherein the abrasive layer has two or more high hardness layers and a low hardness layer having a hardness lower than that of the two or more high hardness layers disposed between two or more high hardness layers, from a surface side of the abrasive layer toward a tip body side, and wherein an intermediate layer having a hardness lower than that of the two or more high hardness layers and a hardness higher than that of the low hardness layer is disposed between one of the two or more high hardness layers in the surface side of the abrasive layer and the low hardness layer, from the surface side of the abrasive layer toward the tip body side.

2. The drill bit button insert according to claim 1, wherein in the abrasive layer, the two or more high hardness layers and the low hardness layer are alternately disposed from the surface side of the abrasive layer toward the tip body side.

3. The drill bit button insert according to claim 1, wherein the thickness of each of the two or more high hardness layers is set to be in a range of ½ or more than the thickness of the low hardness layer, and equal to or less than the thickness of the low hardness layer.

4. A drill bit in which the drill bit button insert according to claim 1 is attached to a button inserts mounted in a drill bit.

* * * * *